US008931404B2

(12) United States Patent
Lai

(10) Patent No.: US 8,931,404 B2
(45) Date of Patent: Jan. 13, 2015

(54) FEEDING AND REVERSING MECHANISM FOR A STRAPPING MACHINE

(76) Inventor: Chien-Fa Lai, Taichung (TW)

( * ) Notice: Subject to any disclaimer, the term of this patent is extended or adjusted under 35 U.S.C. 154(b) by 179 days.

(21) Appl. No.: 13/537,130

(22) Filed: Jun. 29, 2012

(65) Prior Publication Data

US 2013/0014653 A1 Jan. 17, 2013

(30) Foreign Application Priority Data

Jul. 13, 2011 (GB) ..... 1111982.3

(51) Int. Cl.
*B65B 13/22* (2006.01)
*B65B 13/06* (2006.01)
*B65B 13/32* (2006.01)

(52) U.S. Cl.
CPC ..... *B65B 13/06* (2013.01); *B65B 13/22* (2013.01); *B65B 13/32* (2013.01)
USPC ..... 100/32; 100/26; 100/29; 226/177; 226/187

(58) Field of Classification Search
CPC ..... B65B 13/22
USPC ..... 100/26, 29, 32; 56/589; 254/216; 226/177, 186, 187; 242/418, 564.4; 53/589
See application file for complete search history.

(56) References Cited

U.S. PATENT DOCUMENTS 2,361,470 A * 10/1944 Flood ..... 53/399
3,566,778 A * 3/1971 Vilcins ..... 100/2
4,218,969 A * 8/1980 Kasuga ..... 100/32
4,912,912 A * 4/1990 Tagomori ..... 53/589
5,377,477 A * 1/1995 Haberstroh et al. ..... 53/399
5,509,594 A * 4/1996 Maggioni ..... 226/35
7,082,872 B2 * 8/2006 Goodley ..... 100/32
7,165,379 B1 * 1/2007 Lai ..... 53/589

FOREIGN PATENT DOCUMENTS

DE 1650691 A * 8/1972 ..... B65H 3/04
EP 95643 A * 12/1983 ..... B65B 13/22
FR 2141357 A * 1/1973 ..... B65B 27/00
GB 2041869 A * 9/1980 ..... B65B 13/18

* cited by examiner

*Primary Examiner* — Shelley Self
*Assistant Examiner* — Leonel Vasquez
(74) *Attorney, Agent, or Firm* — Alan D. Kamrath; Kamrath IP Lawfirm, P.A.

(57) ABSTRACT

A feeding and reversing mechanism for a strapping machine includes a forward-reverse wheel assembly and a tension wheel assembly which are mounted on a base and arranged in such a way to provide larger contact areas between a strapping band and the two wheel assemblies. The feeding and reversing mechanism further includes first and second spring units. The first spring unit helps to keep a suitable gap between an active wheel and a passive wheel of the tension wheel assembly for the strapping band to pass through. The second spring unit helps to move the passive wheel toward the active wheel of the tension wheel assembly, so that the strapping band can be clamped between the passive wheel and the active wheel tightly to facilitate reversing and tightening of the strapping band.

6 Claims, 10 Drawing Sheets

FEEDING AND REVERSING MECHANISM FOR A STRAPPING MACHINE

BACKGROUND OF THE INVENTION

1. Field of the Invention

The present invention relates to a feeding and reversing mechanism for a strapping machine and, more particularly, to a mechanism used for retracting and tightening a strapping band for strapping machines.

2. Description of the Related Art

FIG. 10 shows a conventional mechanism 90 for feeding and reversing a strapping band for a strapping machine which includes a feeding motor 91 and a reversing motor 93. The feeding motor 91 drives a feeding wheel 911 to feed a strapping band 92 from a storage box for strapping objects or articles. The reversing motor 93 drives a reversing wheel 931 to retract the strapping band 92 for tightening the objects. Furthermore, first and second sensors 94 and 95 are provided for counting the rotating times of the feeding wheel 911 and the reversing wheel 931 respectively to help measure the length of the strapping band 92 being used, in order to provide and replenish the strapping band 92 accurately. However, the mechanism 90 needs two motors, i.e. the feeding motor 91 and the reversing motor 93, consuming more electricity. In addition, there is only a point contact between the strapping band 92 and each of the feeding wheel 911 and the reversing wheel 931, which provide an inadequate force for clamping the strapping band 92, resulting in slipping during the reversing process of the strapping band 92. Thus, the conventional feeding and reversing mechanism 90 is ineffective for strapping the objects.

BRIEF SUMMARY OF THE INVENTION

Thus, it is an objective of the present invention to overcome the aforementioned shortcoming and deficiency of the prior art by providing a feeding and reversing mechanism for a strapping machine. The feeding and reversing mechanism of the present invention can be used for retracting and tightening a strapping band and has the advantages of simple structure. Further, the strapping band can be clamped tightly during the reversing process without slipping to provide a better strapping result.

To achieve the foregoing objective, a feeding and reversing mechanism for a strapping machine of the present invention includes a base, a forward-reverse wheel assembly, a tension wheel assembly, first and second arms, and first and second spring units. The base includes an installation wall provided with a pivot thereon. The forward-reverse wheel assembly is mounted on the installation wall and includes an active wheel and a passive wheel adjacent to the active wheel for feeding and reversing a strapping band passing between the active wheel and the passive wheel. The tension wheel assembly is mounted on the installation wall and includes a tension active wheel and a tension passive wheel adjacent to the tension active wheel. The first arm includes spaced first and second ends. The first end of the first arm is mounted around the pivot so that the first arm is pivotable about an axis defined by the pivot. The tension passive wheel is mounted on the second end of the first arm and movable relative to the tension active wheel. The second arm includes spaced first and second ends. The first end of the second arm is mounted around the pivot so that the second arm is pivotable about the axis defined by the pivot. A rotary member is mounted to the second end of the second arm and is in contact with a cam. The first spring unit includes a first spring and a fixing piece and is mounted on the first arm by extending the fixing piece through the first spring and the first arm. The first spring biases the first arm so that a gap is provided between the tension passive wheel and the tension active wheel for the strapping band to pass through. The second spring unit includes a second spring and a fastener and is installed on the first and second arms by extending the fastener through the second spring, the first arm, and the second arm. The second arm is pivoted to move the tension passive wheel and the first arm when the cam rotates, so that the tension passive wheel is moved toward the tension active wheel to clamp the strapping band securely.

In a preferred form, a band guiding member is disposed on the installation wall. The tension active wheel is disposed below the band guiding member in a vertical direction, and the tension passive wheel is disposed above the tension active wheel in the vertical direction and adjacent to a bottom of the band guiding member. Further, the tension active wheel is disposed between the active wheel of the forward-reverse wheel assembly and the tension passive wheel.

Preferably, a contact surface between the strapping band and the tension active wheel is larger than half of an outer periphery of the tension active wheel, and a contact surface between the strapping band and the active wheel of the forward-reverse wheel assembly is larger than half of an outer periphery of the active wheel.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
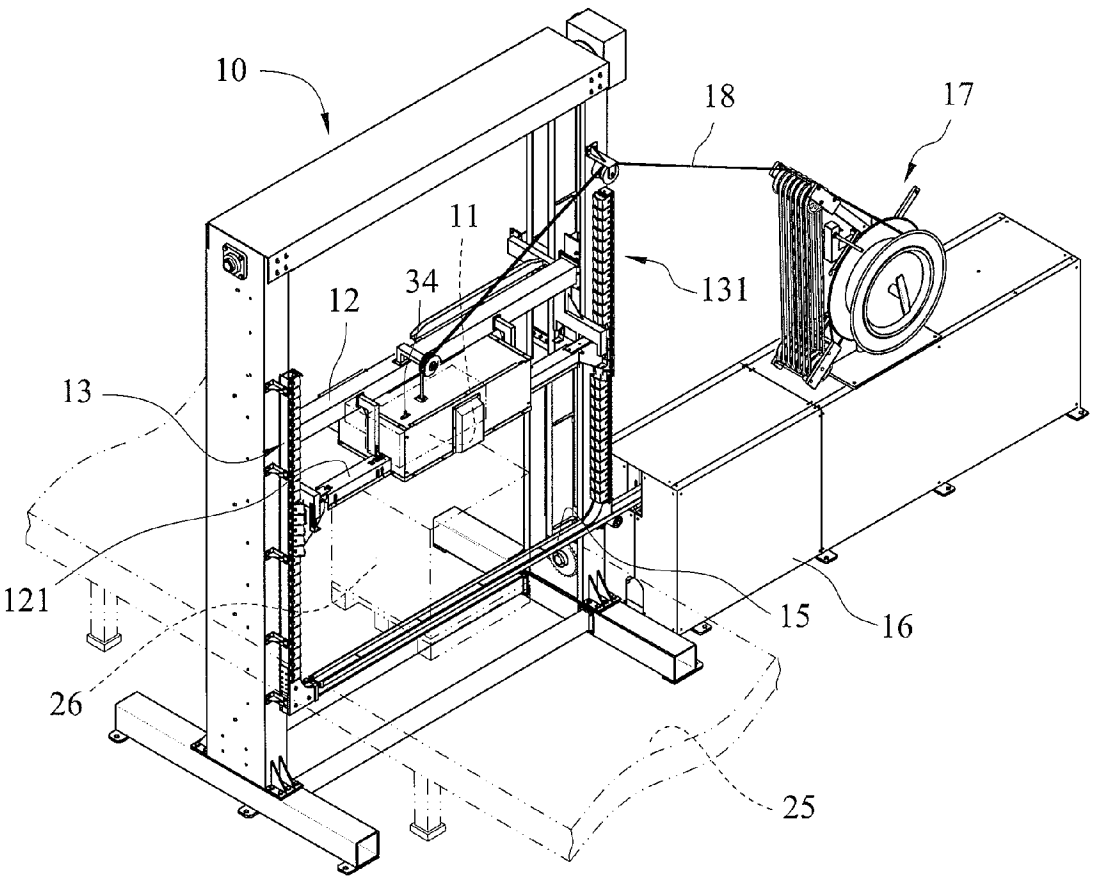
FIG. 1 shows a diagrammatic, perspective view of a strapping machine utilizing a feeding and reversing mechanism according to the preferred teachings of the present invention.
Figure 2:
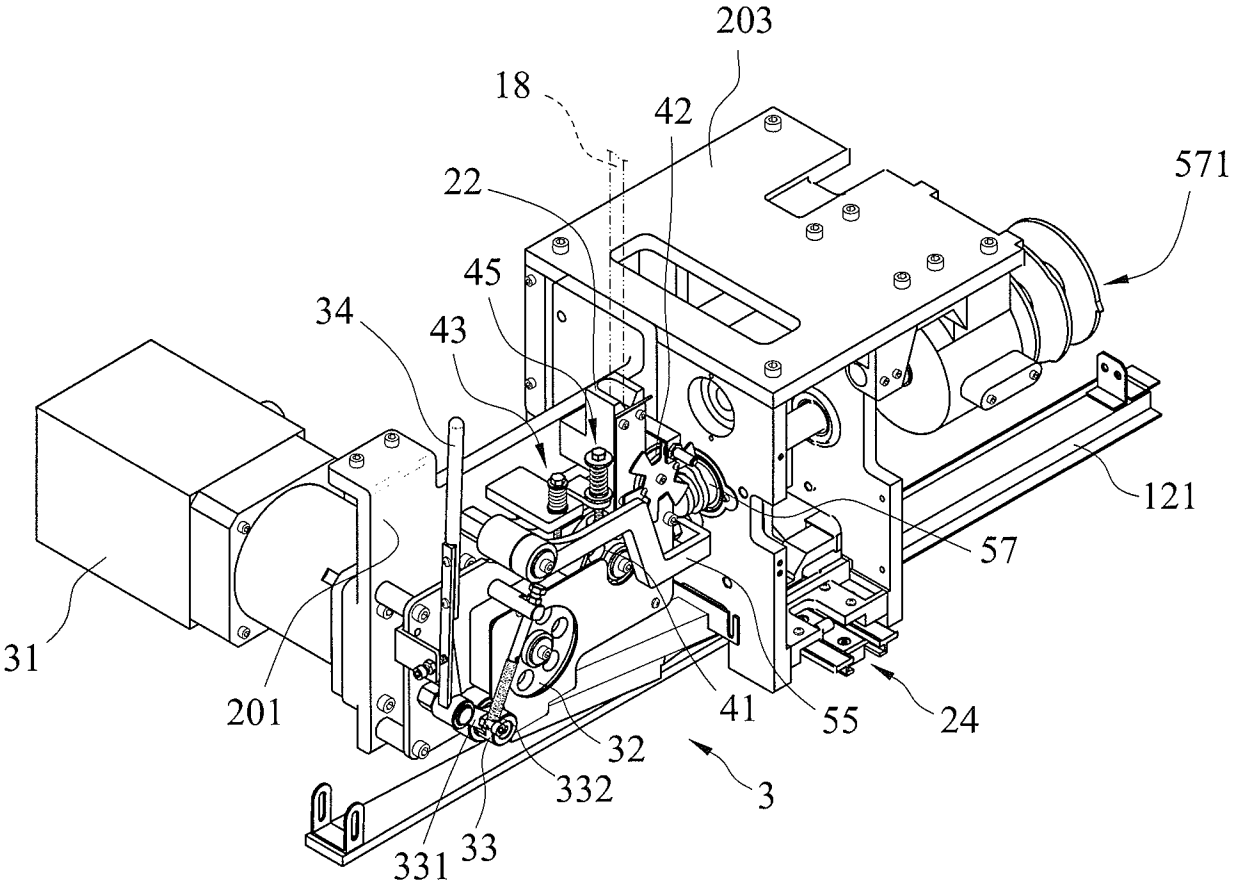
FIG. 2 shows a perspective view of the feeding and reversing mechanism of the present invention, with the feeding and reversing mechanism being a part of a machine center of the strapping machine of FIG. 1.

FIG. 1 shows a door-shaped strapping machine including a frame 10, a machine center 11, a movable member 15, and two band rails 13 and 131. The machine center 11 is installed between an upper bar 12 and a lower bar 121. The upper bar 12 can be moved by transmission of chain wheels and chains (not shown) so that the machine center 11 is movable upward and downward with the upper bar 12. The band rails 13 and 131 are disposed on two vertical sides of the frame 10. Two ends of the lower bar 121 are connected to the band rails 13 and 131 respectively. The movable member 15 is in the form of a rail and is movably mounted in a chassis 16. During a strapping process, the movable member 15 is driven out from the chassis 16 and disposed under the band rails 13 and 131, so that the movable member 15, the lower bar 121, and the band rails 13 and 131 together form a rectangular band rail for transporting a strapping band 18. A band storage mechanism 17 is installed on the chassis 16 for storing the strapping band 18.

A feeding and reversing mechanism for a strapping machine according to the preferred teachings of the present invention is shown in FIGS. 2 through 8 of the drawings and generally designated 3. The feeding and reversing mechanism 3 of the present invention is a part of the machine center 11 in FIG. 1, allowing the strapping band 18 to be able to strap objects tightly. The feeding and reversing mechanism 3 includes a base 200, a forward-reverse wheel assembly 30, a tension wheel assembly 40, first and second aims 50 and 55, and first and second spring units 43 and 45. The base 200 includes a vertical installation wall 201 and a horizontal base plate 203. The installation wall 201 is disposed above the lower bar 121 and provided with a pivot 501. A gear drive assembly 21 is disposed on the installation wall 201 for driving the forward-reverse wheel assembly 30 and the tension wheel assembly 40. A band guiding member 22 with a guiding groove is mounted on the installation wall 201 for directing the strapping band 18 to feed or retract. An operation area 24 is disposed below the base plate 203 for fusing and cutting the strapping band 18 (see FIG. 2).

Figure 4:
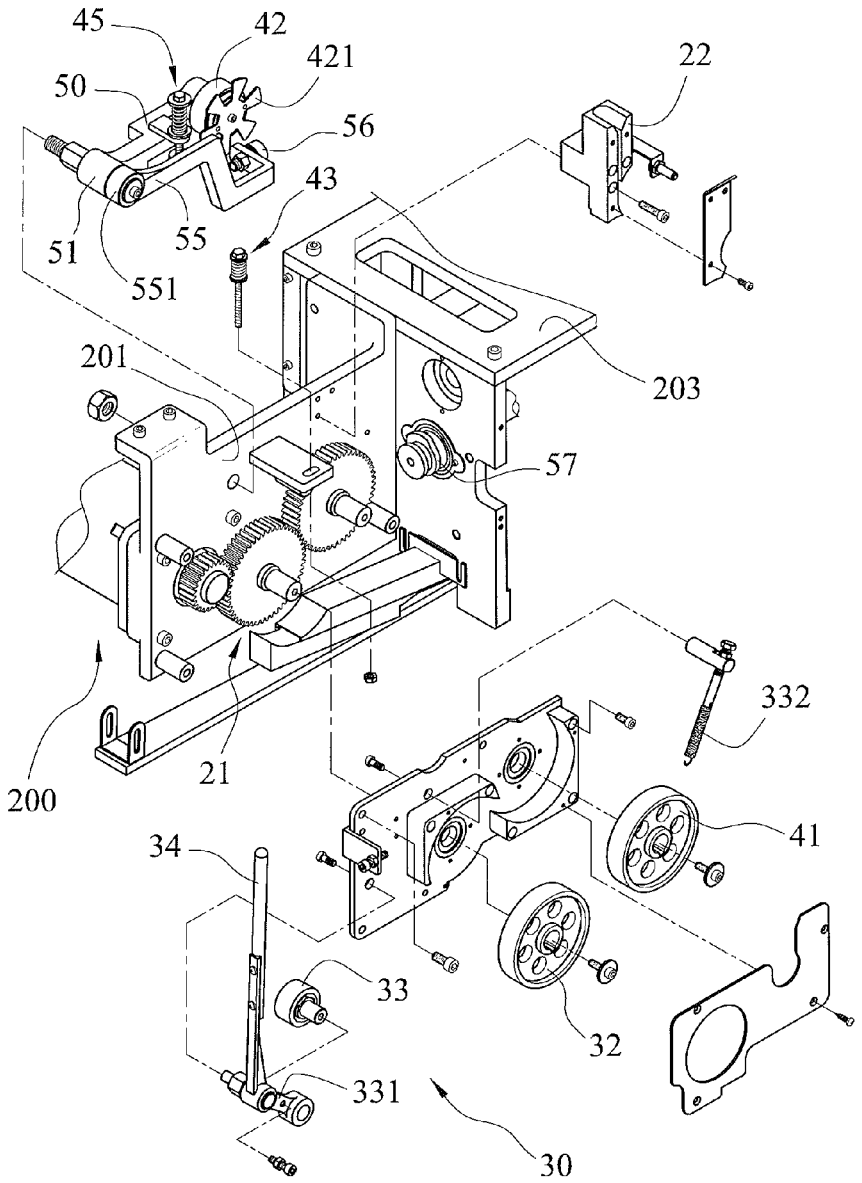
FIG. 4 is an exploded, perspective view of the feeding and reversing mechanism of FIG. 2.
Figure 5:
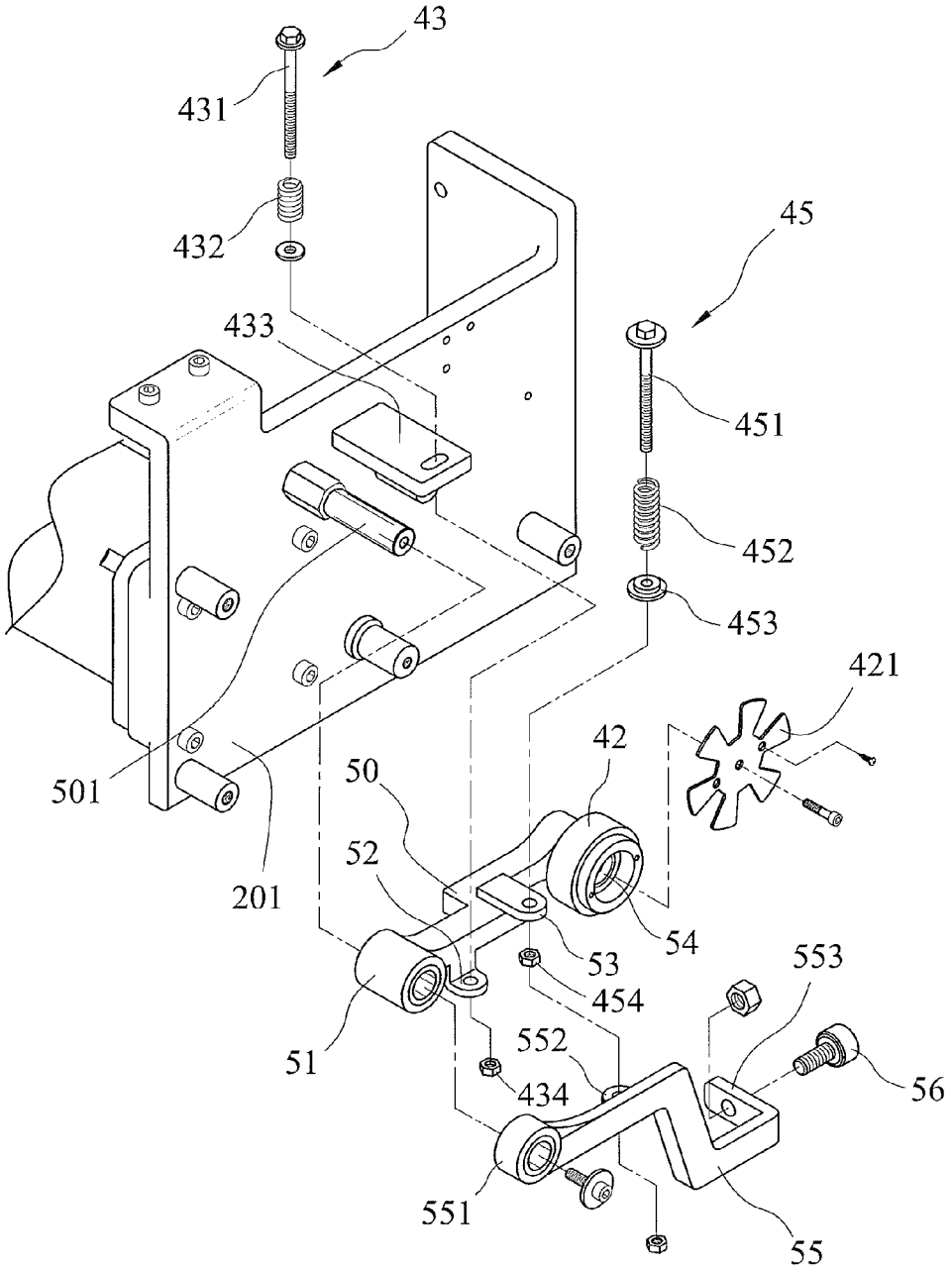
FIG. 5 is a partial, exploded, perspective view of the feeding and reversing mechanism of FIG. 4.
Figure 6:
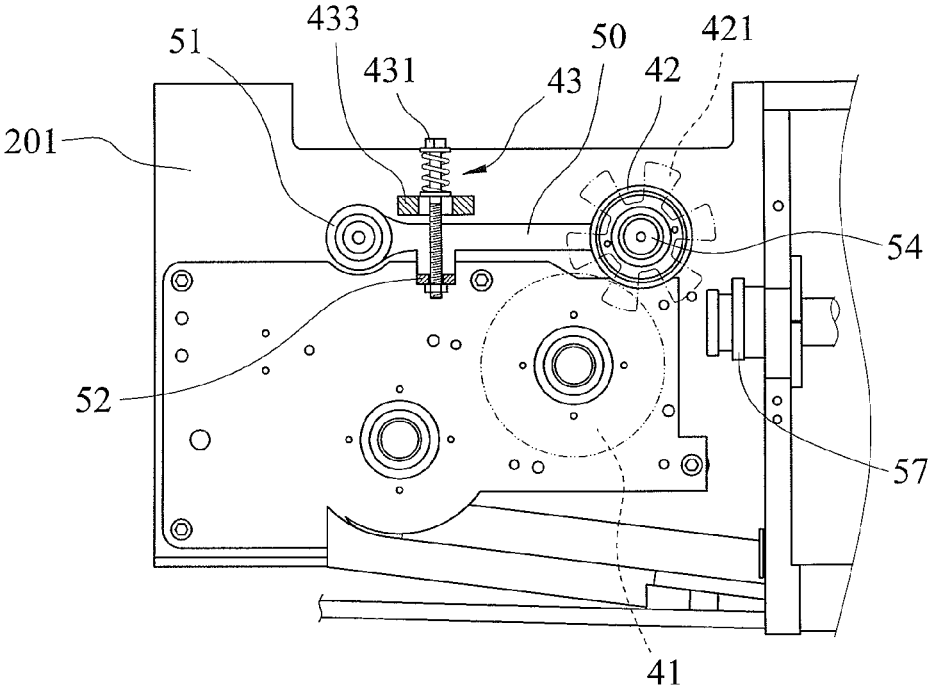
FIG. 6 is a view showing an assembled state of a first spring unit and a first arm of the feeding and reversing mechanism of FIG. 2.

The forward-reverse wheel assembly 30 includes an active wheel 32 and a passive wheel 33 (FIG. 4). The active wheel 32 is mounted on the installation wall 201 and driven by a motor 31. The passive wheel 33 is connected to one end of a swing arm 331 so that the passive wheel 33 is movable relative to the active wheel 32. The other end of the swing arm 331 is mounted on the installation wall 201 and engaged with a pressing bar 34. When the pressing bar 34 is pulled, the swing arm 331 and the passive wheel 33 are moved together away from the active wheel 32, allowing the strapping band 18 to be extended through between the active wheel 32 and the passive wheel 33. Furthermore, a spring 332 is connected between the swing arm 331 and the installation wall 201. The elasticity of the spring 332 biases the passive wheel 33 towards the active wheel 32 when the pressing bar 34 is released, so that the passive wheel 33 and the active wheel 32 can clamp the strapping band 18 for feeding and reversing the strapping band 18.

Figure 3:
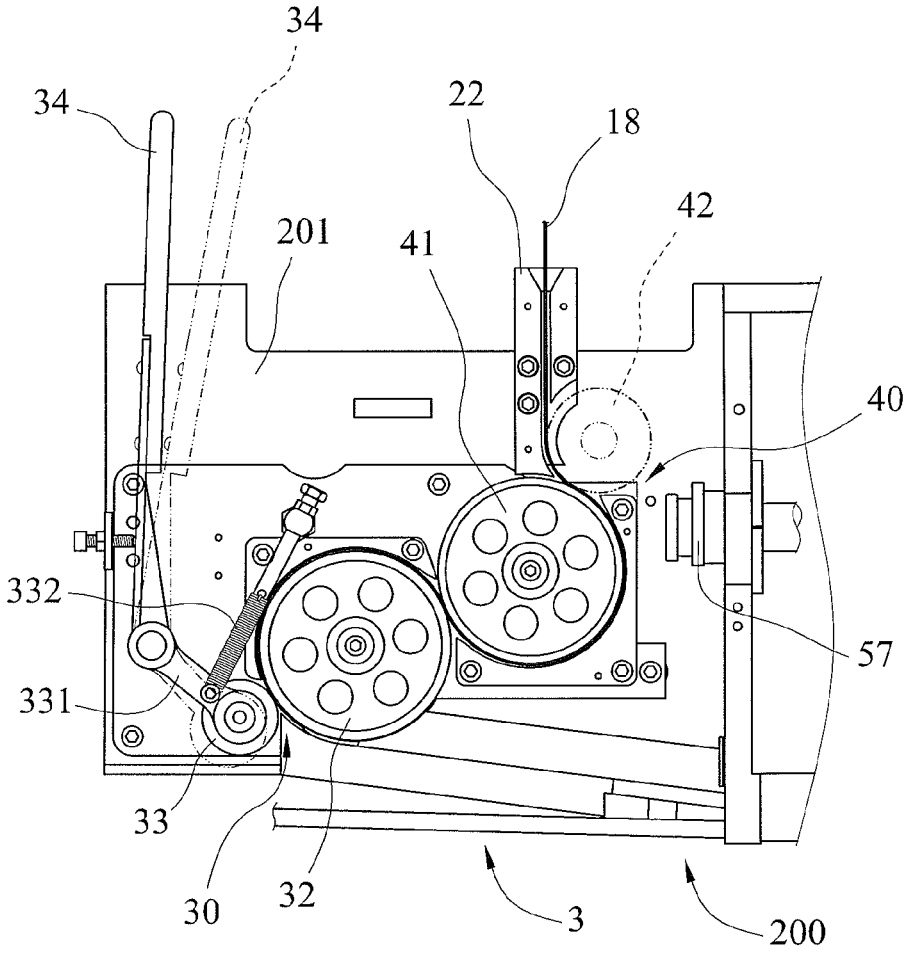
FIG. 3 is a front plan view of the feeding and reversing mechanism of FIG. 2.

The tension wheel assembly 40 includes a tension active wheel 41 and a tension passive wheel 42. The tension active wheel 41 is mounted on the installation wall 201 and can be driven by the gear drive assembly 21 to turn. The tension active wheel 41 is disposed below the band guiding member 22 in a vertical direction. The tension passive wheel 42 is disposed above the tension active wheel 41 in the vertical direction and adjacent to a bottom of the band guiding member 22. Moreover, the tension active wheel 41 is disposed between the active wheel 32 of the forward-reverse wheel assembly 30 and the tension passive wheel 42. When the strapping band 18 extends downward from the band guiding member 22, it will go around the tension active wheel 41 and then the active wheel 32, such that a contact surface between the strapping band 18 and the tension active wheel 41 is larger than half of an outer periphery of the tension active wheel 41, and such that a contact surface between the strapping band 18 and the active wheel 32 is larger than half of an outer periphery of the active wheel 32 (FIG. 3).

The first arm 50 includes spaced first and second ends 51 and 54. The first end 51 is installed around the pivot 501 of the installation wall 201 (FIG. 5), so that the first arm 50 is pivotable about an axis defined by the pivot 501. The tension passive wheel 42 is mounted to the second end 54 of the first arm 50, allowing joint movement of the tension passive wheel 42 and the first arm 50 relative to the tension active wheel 41. The first arm 50 includes a first engaging ear 52 formed on a bottom thereof and adjacent to the first end 51. The first arm 50 further includes a second engaging ear 53 formed on a top thereof and adjacent to the second end 54. Furthermore, a sensing piece 421 is disposed on an end surface of the second end 54 of the first arm 50 for sensing if the rotating speeds of the tension active wheel 41 and tension passive wheel 42 are the same (It is not a feature of the present invention and therefore will not be mentioned in detail).

The second arm 55 includes spaced first and second ends 551 and 553. The first end 551 is mounted on the pivot 501 of the installation wall 201 (FIG. 5), so that the second arm 55 is pivotable about the axis defined by the pivot 501. The second end 553 is an L-shaped bend relative to the first end 551 and extends in parallel to the axis of the pivot 501. A rotary member 56, which is a bearing in this embodiment, is mounted on the second end 553 and gets in contact with a cam 57 driven by a motor 571, so that the second arm 55 swings when the cam 57 rotates. The second arm 55 includes a connecting ear 552 which is aligned with the second engaging ear 53 of the first arm 50 in the vertical direction.

The first spring unit 43 includes a spring 432 and a fixing piece 431. The fixing piece 431 extends through the spring 432, an installation plate 433 protruded from the installation wall 201, and the first engaging ear 52 of the first arm 50. A nut 434 is coupled to an end of the fixing piece 431 to install the first spring unit 43 on the first arm 50. The spring 432 can bias the first arm 50 so that a gap is maintained between the tension passive wheel 42 and the tension active wheel 41 for the strapping band 18 to pass through.

The second spring unit 45 includes a spring 452 and a fastener 451. The fastener 451 extends through the spring 452, a washer 453, the second engaging ear 53 of the first arm 50, and the connecting ear 552 of the second arm 55. A nut 454 is coupled to an end of the fastener 451 to install the second spring unit 45 on the first and second arms 50 and 55.

The procedures for strapping objects using the strapping machine are mentioned hereinafter. When an object 26 is placed on a conveyor 25 (see FIG. 1) and touches a photoelectric switch on the conveyor 25, the machine center 11 will descend and stop at a preset position near the object 26. As the machine center 11 descends, the movable member 15 extends out from the chassis 16 and reaches under the two band rails 13 and 131. Then, the band storage mechanism 17 starts feeding the strapping band 18. During the feeding process, the strapping band 18 delivered from the band storage mechanism 17 extends downward from the band guiding member 22 (see FIGS. 1 through 3), goes around the tension active wheel 41 and the active wheel 32, then passes through the lower bar 121, the band rail 131, the movable member 15, the band rail 13, and finally reaches the operation area 24. When the strapping band 18 reaches a preset location, a photoelectric switch in the machine center 11 will sense that and activates the motor 31 to turn the forward-reverse wheel assembly 30 reversely to retract the strapping band 18.

When the strapping band 18 is retracted to a preset distance from the object 26, photoelectric switches on the band rails 13 and 131 will detect that and activate the motor 571 to turn the cam 57, so that the strapping band 18 is tightened to strap the object 26 tightly. The strapping band 18 is then fused and cut to finish strapping the object 26.

Figure 7:
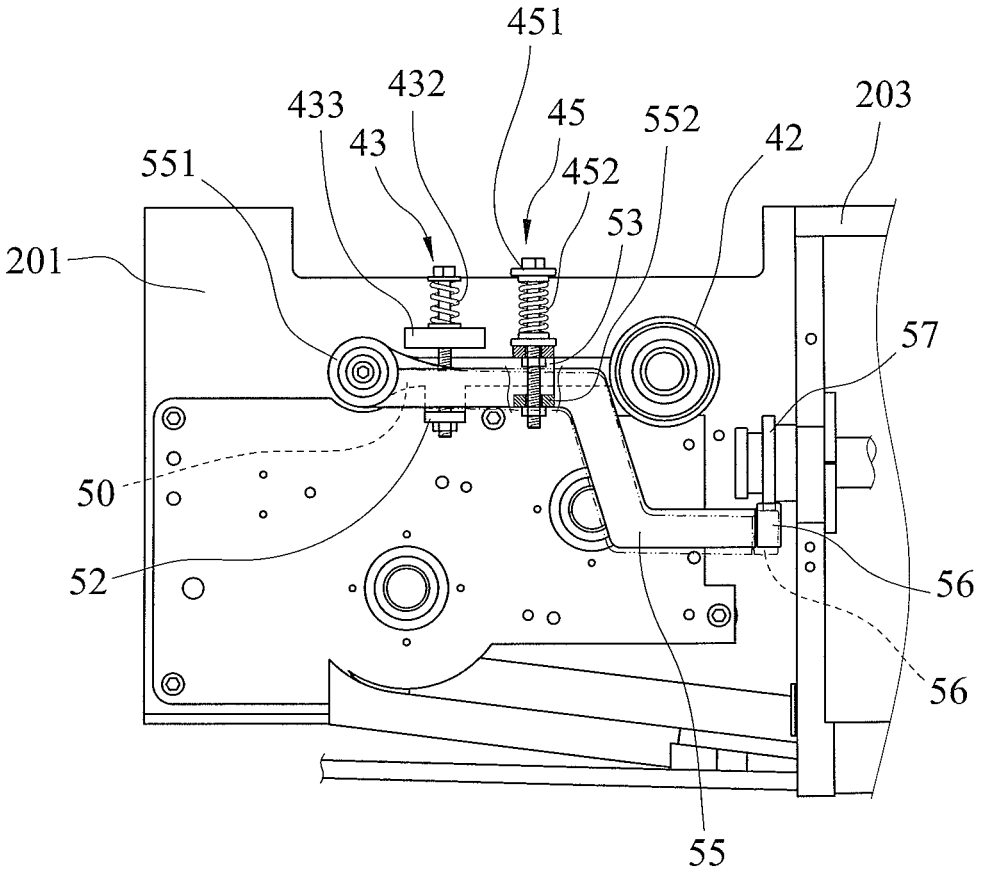
FIG. 7 is a view showing an assembled state of a second spring unit and a second arm of the feeding and reversing mechanism of FIG. 2.
Figure 8:
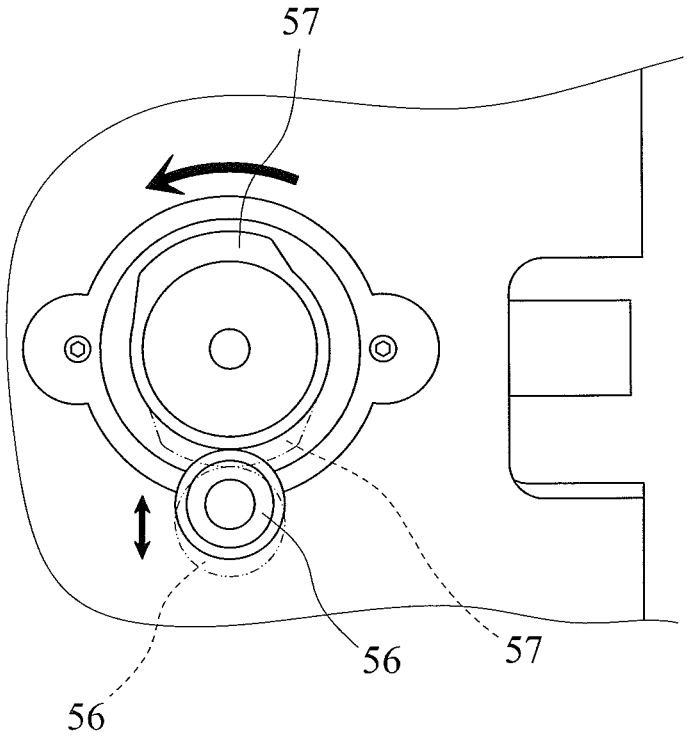
FIG. 8 is a movement illustration of a cam and a rotary member of the feeding and reversing mechanism of FIG. 7.

The feeding and reversing mechanism 3 of the present invention can provide better strapping and tightening results for the object 26. More specifically, the contact surfaces between the strapping band 18 and the tension active wheel 41 as well as the active wheel 32 are larger than half of the outer peripheries of the tension active wheel 41 and the active wheel 32. Therefore, the strapping band 18 can be clamped tightly without slipping during the reversing process. Moreover, when the strapping band 18 is being reversed, the motor 571 drives the cam 57 to rotate intermittently. When the protrusion portion of the cam 57 presses against the rotary member 56, the second arm 55 swings downward with the pivot 501 as the fulcrum (FIG. 7). Therefore, the second spring unit 45 and the first arm 50 are moved to press the tension passive wheel 42 against the tension active wheel 41 to further clamp the strapping band 18 tightly, enhancing the result of strapping the object 26. Furthermore, when the strapping process is finished, the elasticity of the spring 431 of the first spring unit 43 returns the first arm 50 and the tension passive wheel 42 back to their original positions, in order to facilitate the feeding process of the strapping band 18 for a next strapping operation.

Figure 9:
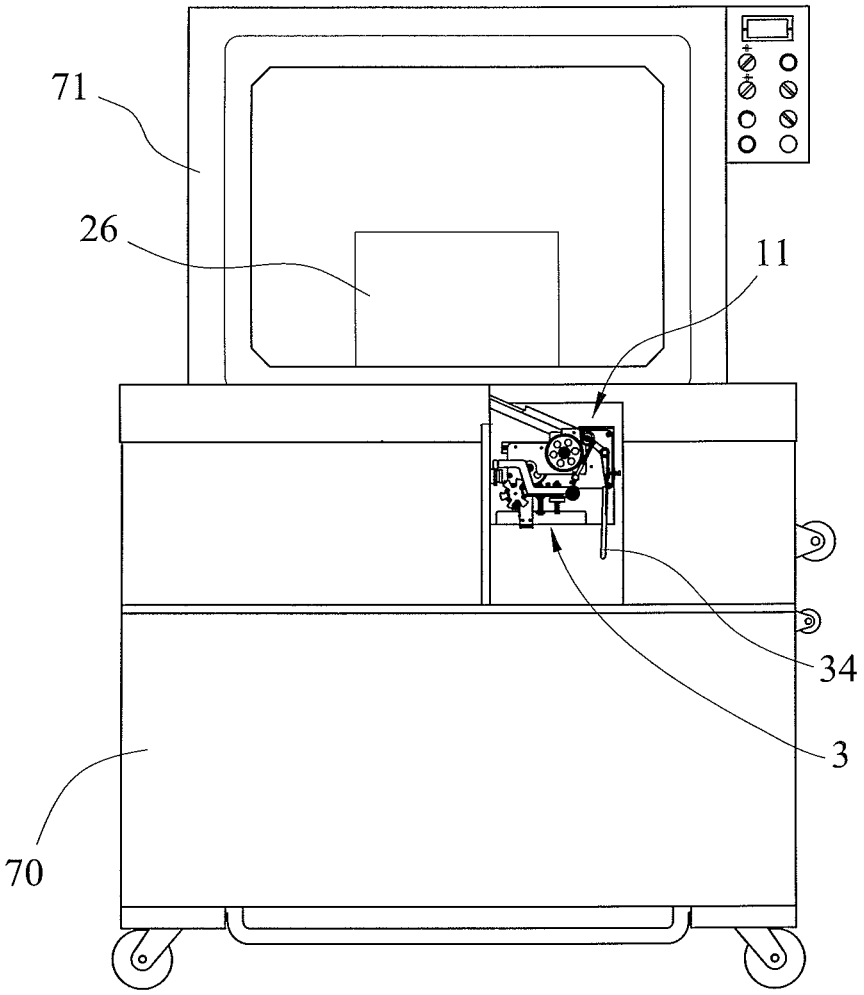
FIG. 9 shows a diagrammatic view of another type of strapping machine utilizing the feeding and reversing mechanism according to the preferred teachings of the present invention.
Figure 10:
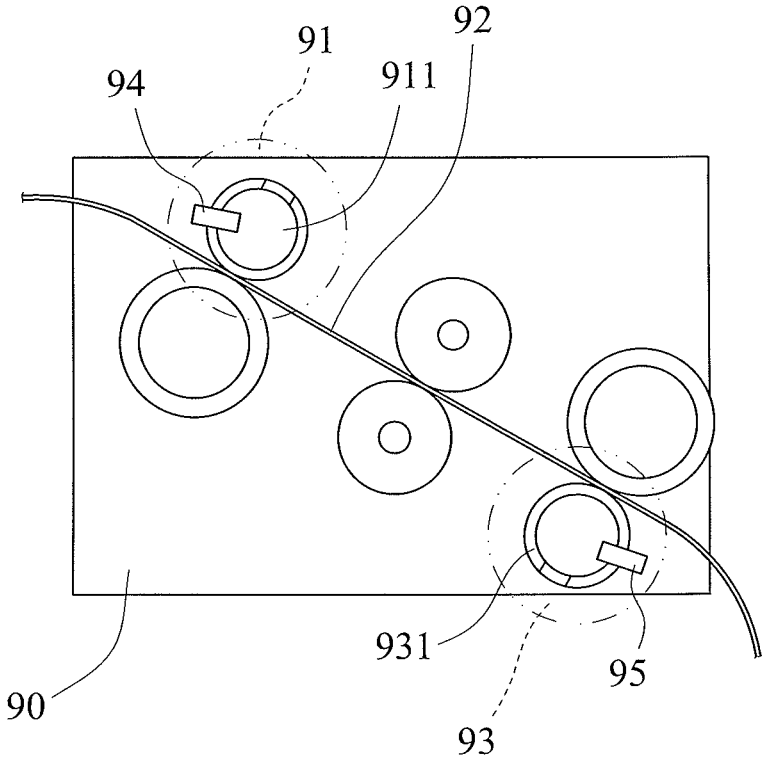
FIG.10 (Prior Art)
FIG. 10 is an illustration of a conventional feeding and reversing mechanism for a strapping machine.

FIG. 9 shows a feeding and reversing mechanism 3 of the present invention being applied in another type of strapping machine 70. The strapping machine 70 has an arch frame 71 on a top thereof; and the object 26 is placed in the arch frame 71. The machine center 11, including the feeding and reversing mechanism 3 of the present invention, is provided in the strapping machine 70. However, when the feeding and reversing mechanism 3 of the present invention is applied in this type of strapping machine 70, the assembling direction of the feeding and reversing mechanism 3 is opposite to that of the strapping machine shown in FIG. 1, with the pressing bar 34 pointing downward.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A feeding and reversing mechanism for a strapping machine, comprising:

an installation wall provided with a pivot thereon;

a forward-reverse wheel assembly mounted on the installation wall and including an active wheel and a passive wheel adjacent to the active wheel for feeding and reversing a strapping band passing between the active wheel and the passive wheel;

a tension wheel assembly including a tension active wheel mounted on the installation wall and a tension passive wheel adjacent to the tension active wheel;

a first arm including spaced first and second ends, with the first end of the first arm pivotable about an axis defined by the pivot, with the tension passive wheel mounted on the second end of the first arm, wherein the tension passive wheel is movable relative to the tension active wheel and is biased away from the tension active wheel;

a cam;

a second arm including spaced first and second ends, with the first end of the second arm pivotable about the axis defined by the pivot, with a rotary member mounted to the second end of the second arm and being in contact with the cam, with the first and second arms resiliently connected together;

a first spring unit including a first spring and a fixing piece, with the fixing piece extending through the first spring and the installation wall and fixed relative to the first arm, with the first spring sandwiched by the fixing piece and the first arm, with the first spring unit biasing the tension passive wheel away from the tension active wheel; and a second spring unit including a second spring and a fastener, with the fastener extending through the second spring and the first arm and fixed relative to the second arm, with the second spring sandwiched by the fastener and the first arm, with the second spring unit resiliently connecting the first and second arms together;

wherein a gap is provided between the tension passive wheel and the tension active wheel for the strapping band to pass through;

wherein the second arm is pivoted by the rotary member to move the tension passive wheel on the first arm toward the tension active wheel to clamp the strapping band securely when the cam rotates; and wherein the forward-reverse wheel assembly is mounted on the installation wall independent of the first and second arms.

2. The feeding and reversing mechanism according to claim 1, with a band guiding member mounted on the installation wall, with the tension active wheel disposed below the band guiding member in a vertical direction, with the tension passive wheel disposed above the tension active wheel in the vertical direction and adjacent to a bottom of the band guiding member, and with the tension active wheel disposed between the active wheel of the forward-reverse wheel assembly and the tension passive wheel.

3. The feeding and reversing mechanism according to claim 2, with a contact surface between the strapping band and the tension active wheel being larger than half of an outer periphery of the tension active wheel, and with a contact surface between the strapping band and the active wheel of the forward-reverse wheel assembly being larger than half of an outer periphery of the active wheel.

4. The feeding and reversing mechanism according to claim 2, with the second end of the second arm being an L-shaped bend relative to the first end of the second arm and extending in parallel to the axis of the pivot, with the rotary member mounted on the L-shaped bend and rotatable about an axis perpendicular to the axis of the pivot.

5. The feeding and reversing mechanism according to claim 2, with the passive wheel of the forward-reverse wheel assembly connected to one end of a swing arm, wherein the passive wheel is movable relative to the active wheel of the forward-reverse wheel assembly, and with another end of the swing arm mounted on the installation wall and engaged with a pressing bar.

6. The feeding and reversing mechanism according to claim 2, with the first arm further including a first engaging ear formed on a bottom thereof and adjacent to the first end of the first arm, with the first arm further including a second engaging ear formed on atop thereof and adjacent to the second end of the first arm, with the fixing piece extending through the first spring, an installation plate protruded from the installation wall, and the first engaging ear of the first arm, with the second arm further including a connecting ear aligned with the second engaging ear of the first arm in the vertical direction, and with the fastener extending through the second spring, the second engaging ear of the first arm, and the connecting ear of the second arm.

* * * * *